US005305289A

United States Patent [19]

Besson et al.

[11] Patent Number: 5,305,289

[45] Date of Patent: Apr. 19, 1994

[54] AUTOMATIC INITIALISATION METHOD FOR AT LEAST THE DATE DISPLAY, A DEVICE FOR PERFORMING THIS METHOD AND A WATCH EQUIPPED WITH SAID DEVICE

[75] Inventors: René Besson, Geneva; Claude-Eric Leuenberger, Geneve-Acacias, both of Switzerland

[73] Assignee: Montres Rolex S.A., Switzerland

[21] Appl. No.: 605,550

[22] Filed: Oct. 30, 1990

[30] Foreign Application Priority Data

Nov. 3, 1989 [CH] Switzerland ..... 03977/89

[51] Int. Cl.[5] ..... G04B 19/24

[52] U.S. Cl. ..... 368/28; 368/37

[58] Field of Search ..... 368/28, 29, 35-37

[56] References Cited

U.S. PATENT DOCUMENTS 4,253,173 2/1981 Jaunin ..... 368/76

4,632,569 12/1986 Gogniat ..... 368/35

4,733,384 3/1988 Meister et al. ..... 368/28

*Primary Examiner*—Vit W. Miska

*Attorney, Agent, or Firm*—Davis, Bujold & Streck

[57] ABSTRACT

The device for implementing the method for the automatic initialisation of the date display of a perpetual calendar electronic watch comprising a face fitted with a window and a date disk permits, every time the watch stops, at the moment the electronic circuit is reconnected, the automatic identification of the date appearing in the window, by optically analysing a code attributed to this date and by memorizing this data by means of the electronic circuit. This optical device (10) comprises a source (11) emitting a beam of light (12), reflective surfaces (13) fixed onto the date disk (15) and a receiver (14). The beam (16) reflected by a surface (13) is intercepted by the receiver (14) which supplies a signal to the electronic circuit (17) which controls an electronic motor (18) driving the disk (15) by a system of reduction gears (19, 20).

10 Claims, 3 Drawing Sheets

Figure 1A:
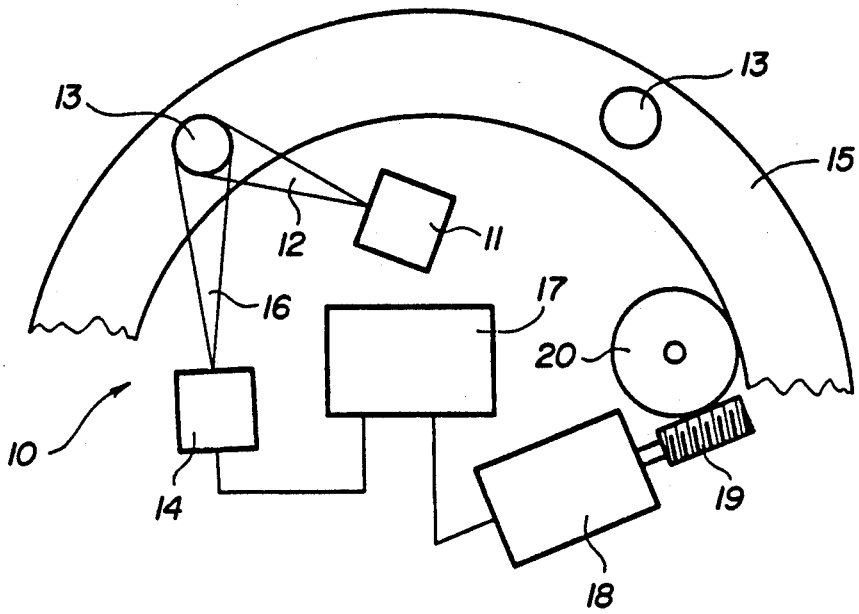

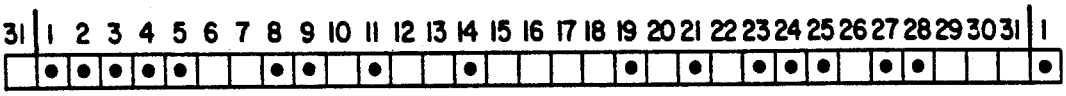
FIG. 9
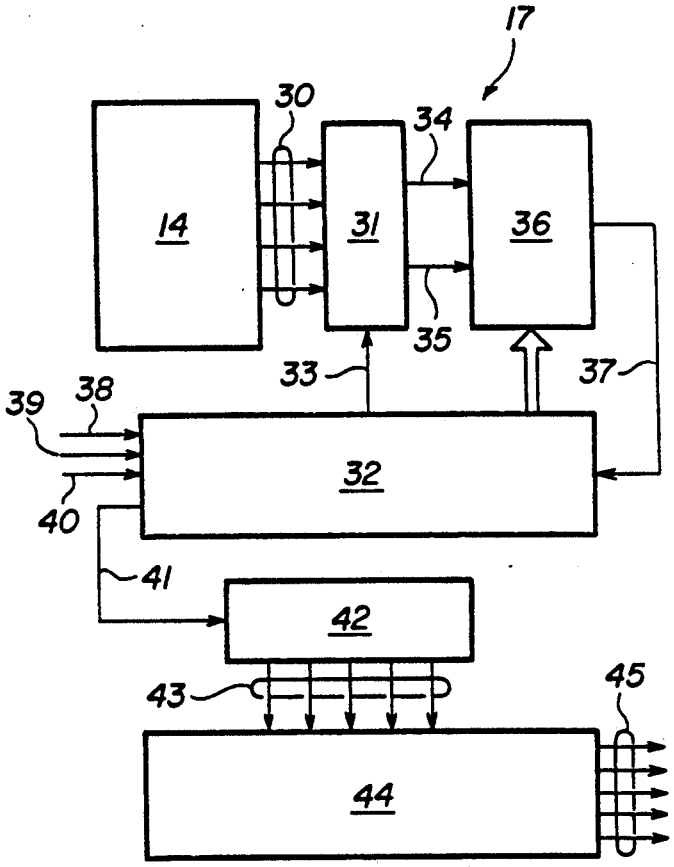
FIG. 8
| | | | | | |
|---|---|---|---|---|---|
| 1 | 0 | 0 | 0 | 1 | 1 |
| 0 | 0 | 0 | 1 | 1 | 2 |
| 0 | 0 | 1 | 1 | 1 | 3 |
| 0 | 1 | 1 | 1 | 1 | 4 |
| 1 | 1 | 1 | 1 | 1 | 5 |
| 1 | 1 | 1 | 1 | 0 | 6 |
| 1 | 1 | 1 | 0 | 0 | 7 |
| 1 | 1 | 0 | 0 | 1 | 8 |
| 1 | 0 | 0 | 1 | 1 | 9 |
| 0 | 0 | 1 | 1 | 0 | 10 |
| 0 | 1 | 1 | 0 | 1 | 11 |
| 1 | 1 | 0 | 1 | 0 | 12 |
| 1 | 0 | 1 | 0 | 0 | 13 |
| 0 | 1 | 0 | 0 | 1 | 14 |
| 1 | 0 | 0 | 1 | 0 | 15 |
| 0 | 0 | 1 | 0 | 0 | 16 |
| 0 | 1 | 0 | 0 | 0 | 17 |
| 1 | 0 | 0 | 0 | 0 | 18 |
| 0 | 0 | 0 | 0 | 1 | 19 |
| 0 | 0 | 0 | 1 | 0 | 20 |
| 0 | 0 | 1 | 0 | 1 | 21 |
| 0 | 1 | 0 | 1 | 0 | 22 |
| 1 | 0 | 1 | 0 | 1 | 23 |
| 0 | 1 | 0 | 1 | 1 | 24 |
| 1 | 0 | 1 | 1 | 1 | 25 |
| 0 | 1 | 1 | 1 | 0 | 26 |
| 1 | 1 | 1 | 0 | 1 | 27 |
| 1 | 1 | 0 | 1 | 1 | 28 |
| 1 | 0 | 1 | 1 | 0 | 29 |
| 0 | 1 | 1 | 0 | 0 | 30 |
| 1 | 1 | 0 | 0 | 0 | 31 |
FIG. 10

AUTOMATIC INITIALISATION METHOD FOR AT LEAST THE DATE DISPLAY, A DEVICE FOR PERFORMING THIS METHOD AND A WATCH EQUIPPED WITH SAID DEVICE

The present invention relates to an automatic initialisation method for the date display in a perpetual calendar electronic watch, comprising a face fitted with at least one window and at least one date disk driven by an electric motor which is powered by a battery and controlled by an electronic circuit, this disk being disposed in such a way that the dates appear successively in the window.

It also relates to an automatic initialisation device for at least the date display in a perpetual calendar electronic watch, comprising a face fitted with at least one window and at least one date disk driven by an electric motor which is powered by a battery and controlled by an electronic circuit, this disk being disposed in such a way that the dates appear successively in the window, for performing this method.

Finally it relates to a perpetual calendar electronic watch fitted with such a device.

Because of horological requirements for low consumption and miniaturisation, it has not been possible until now to realise a device capable firstly of identifying and secondly of centring precisely the number of the day of the month, called the date, appearing in the window provided in the face of the watch.

For the perpetual calendar watch, the electronic "knowledge" of the date displayed mechanically by the date disk is necessary so that corrections to the date at the end of any month lasting less than 31 days are taken into consideration and performed. These corrections in respect of the end of the month, which are controlled electronically, depend on the month and the year, and the occurrence of leap years, and these parameters are memorised and controlled by the integrated circuit of the watch.

In the prior art, various methods have been proposed so that the electronic system knows the positions of the date disk where a correction should be made. These methods are hampered by mechanical problems and/or problems of manipulation. They sometimes require the use of an appliance specifically designed to reinitialise the watch after each battery change, and there must be an after-sales service for this appliance, which is a significant constraint.

One alternative, which is mechanical by nature and known from European Patent Application no. 231 451, consists in identifying a particular date by a circuit breaker connected to the electronic circuit, which is opened or closed by the action of a cam and of a flat spring. This process produces additional mechanical friction which has to be overcome with the drive motor, which as a result has to be overdimensioned. Consequently, an increase in the space required and in energy consumption will be observed. The additional friction is also prejudicial to the reliability of the mechanism, particularly with respect to the centring of the date in its window.

The solution described in Swiss Patent Application no. 04385/87-0, which does not comprise a date reader, requires an additional manipulation which the operator has to perform after each battery change. In fact, after having set the date display in the window to the correct date, the operator, in the programming procedure, again has to introduce this same date into the memory of the integrated circuit. With a date reader in conjunction with the electronic circuit, the second operation is no longer necessary, which simplifies the manipulation during the battery change, and, in particular, prevents any discrepancy between the electronic date and the date displayed.

Other Swiss patent applications from the same applicant describe constructive refinements to these drive devices for calendar disks (day and date). One of these refinements relates to automatic recentring after a battery change. If the battery runs down during the date change operation, which happens frequently, as the battery is very stressed during this operation, the disk (disks) stops (stop) between two dates, and the readings are not in the centre of the windows. Swiss patent application no. 02014/87-9 describes a device where an engaging operation enables recentering by a backwards and forwards movement right up to the stops of a drive wheel cooperating with the display disk. Another property described in this patent application and originating from the same process relates to the correction of lost rated steps of drive motors.

The object of the invention is to go beyond developments made to date and to remove the drawbacks of known systems, by allowing the date to be read automatically, the date displayed in the window of the watch face to be recentred, if necessary, and, if appropriate, the rated steps to be corrected.

To achieve this object, the method according to the invention is characterised in that every time the watch stops, at the moment when the electronic circuit is switched on again, the date appearing in the window is automatically identified, by optically analysing a code attributed to this date, and this data is memorised by means of the electronic circuit.

To identify the date appearing in the window, there can be used: an optical device comprising a fixed source emitting a beam of light, mounted inside the watch beneath the plane of the date disk, a set of reflective surfaces integral with the date disk and disposed on its face opposite to that bearing the inscriptions of the dates, and a receiver sensitive to the radiation emitted by the source and reflected by the reflective surfaces, this receiver being fixed and disposed inside the watch beneath the plane of the date disk, to each of the dates of the disk there is associated either a reflective surface or a non-reflective surface, depending on said code to be attributed to the date to be identified, and the presence of a reflective surface or of a non-reflective surface is detected by means of the optical device for a determined number of dates.

A code with "n" binary units of information is preferably attributed to each date, for "n" successive dates appearing in the window there is determined the presence of a reflective surface or that of a non-reflective surface respectively associated to these dates and the code for the date to be identified is defined by attributing a binary number (0 or 1) to all the dates associated with a reflective surface and the other binary number (1 or 0) to all the dates associated with a non-reflective surface.

During a first phase, the date disk is advantageously displaced until a date associated with a reflective surface appears in the window and this date is detected by analysing the output signal of the receiver.

During a second phase, the date previously detected and associated with a reflective surface is centred by determining the position of the disk in which the signal emitted by the receiver is maximal.

During a third phase, the date disk is displaced by an angular unit equal to 360°/31 positions and the presence of a reflective surface or of a non-reflective surface is detected for the purpose of attributing the binary number corresponding to the date appearing in the window, then this displacement of the disk is repeated "n−2" times in succession by said angular unit by detecting each time the presence of a reflective surface or of a non-reflective surface and by attributing to each of these n−2 dates the appropriate binary number, in such a way that at the end of this third phase there is a code of "n" binary units of information enabling the date appearing in the window to be identified.

The identification code for a date preferably comprises five binary units of information.

To detect the presence of a reflective surface or of a non-reflective surface, a receiver comprising at least three juxtaposed photosensitive cells may be used, and the signal emitted by the central cell is compared with the sum of the signals emitted by the lateral cells, the presence of a reflective surface corresponding to a ratio of the signal of the central cell to the signal of the lateral cells which is greater than a predetermined threshold.

To determine the position of the disk for which the date is centred in the window, a receiver comprising at least two photosensitive cells is preferably used and the signal emitted by each of the cells is compared, the date being centred in the window when the ratio of the signals emitted by each of the cells is equal to one.

The same receiver is preferably used to centre the date in the window and to detect the presence of a reflective surface and the juxtaposed photosensitive cells comprising this receiver are connected electronically into two identical groups to ensure the first function and into two groups comprising respectively central cells and lateral cells to ensure the second function.

In a particularly advantageous manner, the receiver comprises at least four juxtaposed photosensitive cells.

According to a preferred embodiment of the method of the invention, the date identification code is based on a serial code having thirty-one states.

Also to achieve this object, the device specified by the invention is characterised in that it comprises an optical device designed to analyse a code attributed to a date appearing in the window, and a memory unit for memorising this data.

According to a first advantageous embodiment, the optical device comprises a fixed source emitting a beam of light, mounted inside the watch beneath the plane of the date disk, a set of reflective surfaces integral with the date disk and disposed on its hidden face through the window, and at least one receiver sensitive to the radiation emitted by the source and disposed inside the watch beneath the plane of the date disk.

According to a second advantageous embodiment of the device according to the invention, the receiver comprises a series of juxtaposed photosensitive cells, these cells being connected in two groups to the electronic circuit by electronic circuit breakers.

According to a first configuration, the receiver preferably comprises an even number of photosensitive cells, these cells being subdivided into a first group of cells connected in parallel and providing a first current, the intensity of which is proportional to the incident light, and into a second group of cells connected in parallel, the number of which is identical to that of the cells of the first group, and providing a second current, the intensity of which is proportional to the incident light, and the electronic circuit comprises means for comparing the values of the intensities of the first and of the second current and for memorising the position of the date disk for which the ratio of these intensities is equal to one.

According to a second configuration, the receiver comprises two groups of photosensitive cells, i.e. a group of central cells which are connected in parallel, and a group of lateral cells disposed on both sides of the central cells and which are connected in parallel, and the electronic circuit is designed to compare the intensity of the current from the group of central cells and the intensity of the currents from the group of lateral cells, and to memorise the position of the date disk for which the ratio of these two values is greater than a predetermined value.

The electronic circuit is preferably designed to attribute the binary number (0 or 1) to the dates appearing in the window for which the ratio of said values is greater than said predetermined value and the other binary number (1 or 0) to the dates appearing in the window, for which the ratio of said values is less than said predetermined value.

This electronic circuit may also comprise a memory unit for memorising the binary number attributed to each date.

This electronic circuit may also be designed to identify a date appearing in the window by attributing a code composed of "n" binary numbers corresponding to (n−1) dates adjacent to the date to be identified.

The code attributed to the dates preferably comprises five binary numbers or binary units of information. It preferably corresponds to five consecutive states of a serial code having thirty-one states.

Figure 1B:
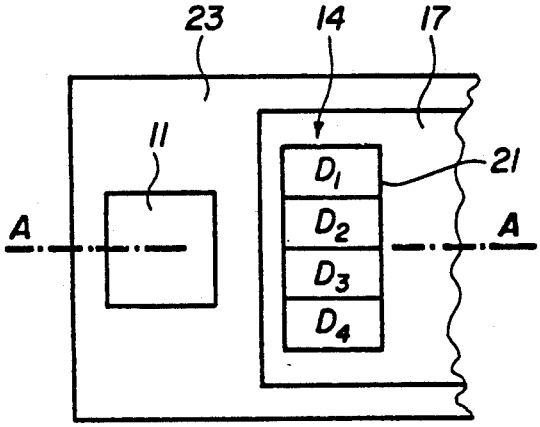
Figure 1C:
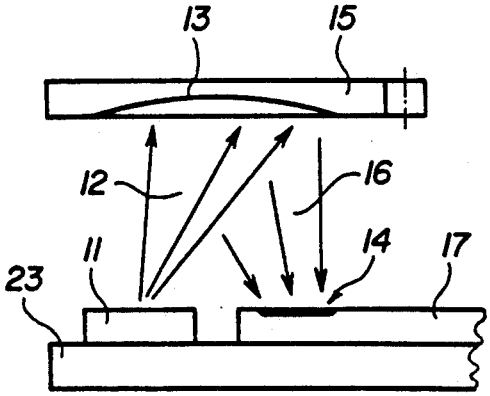
Figure 2:
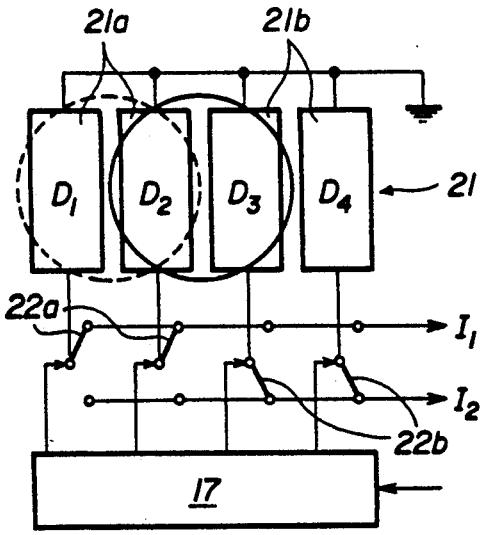
Figure 5:
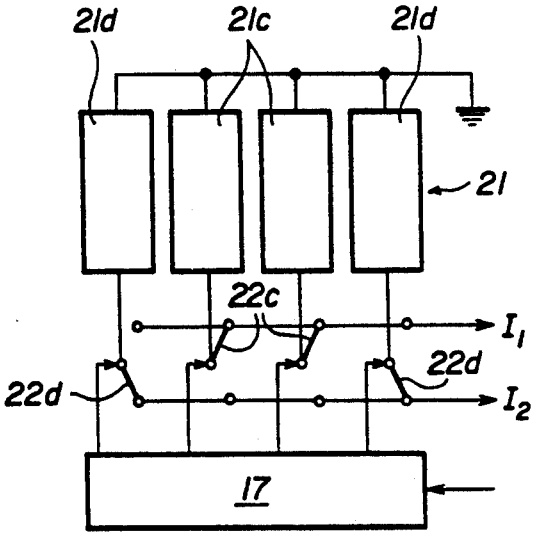
Figure 3:
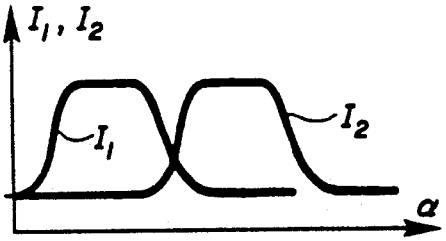
Figure 6:
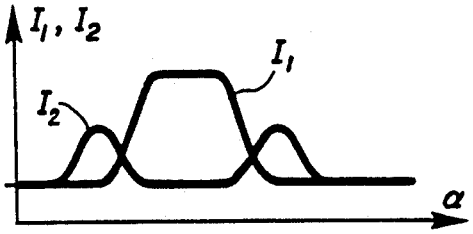
Figure 4:
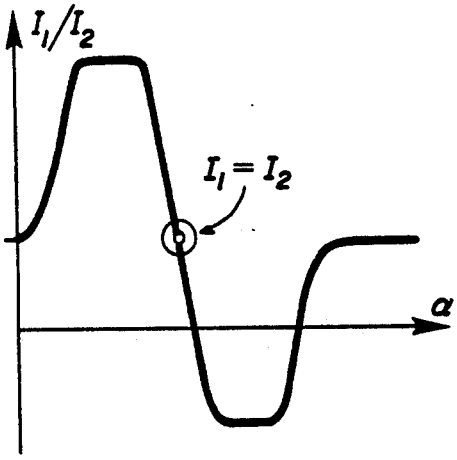
Figure 7:
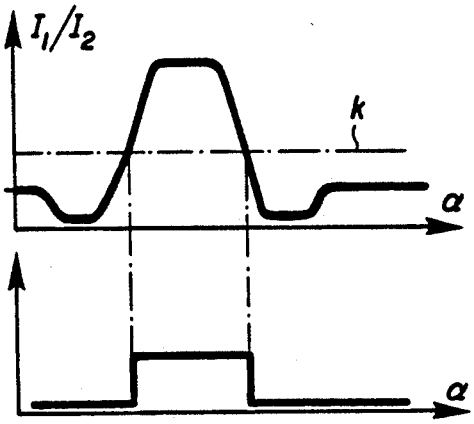

The present invention will be better understood with reference to the description of an exemplified embodiment and to the attached drawings, in which:

FIG. 1A diagrammatically represents an embodiment of the optical device consituting one of the elements of the automatic initialisation device for the date display as specified by the invention, FIG. 1B represents a plan view illustrating the components of the optical device, FIG. 1C represents a sectional view of the optical device, along line A—A of the view of FIG. 1B, FIG. 2 represents a configuration of the receiver for the optical device and the relative arrangement of the photovoltaic cells which form it, corresponding to the the centring function of the disk, FIG. 3 represents the curves of the currents from the cells shown in FIG. 2, as a function of the angle of rotation of the date disk, FIG. 4 represents the curve of the ratio of the currents from the two groups of cells corresponding to the configuration shown by FIG. 2, FIG. 5 represents another configuration of the receiver and more particularly the grouping of cells which form this receiver, corresponding to the detection of a reflective surface, FIG. 6 represents the curves of values of current intensities from the two groups of cells in the configuration shown in FIG. 5, FIG. 7 represents the curve of the ratio of the currents $I_1/I_2$ from the groups of cells of the configuration shown in FIG. 5, FIG. 8 shows the impulses detecting the presence of a reflective surface during the rotation of the date disk, FIG. 9 represents the correspondance of the reflective surfaces and of the numbers of the dates of the date disk, and FIG. 10 illustrates the state table corresponding to the date codes of the date disk.

With reference to FIG. 1A, the optical device 10 shown essentially comprises a source 11, which emits a beam of light 12, a series of reflective surfaces 13 and a receiver 14, which is sensitive to the radiation emitted by the source. This source is, for example, a photo-emittent diode which emits infra-red radiation. By way of example, this source may be a diode made of gallium arsenide of the type SFH 950 manufactured by SIEMENS. The reflective surfaces are advantageously formed by spherical or parabolic concave domes, which may be added and fixed to the lower surface of the date disk 15 or by zones which are stamped and polished or treated in an appropriate manner, directly formed on disk 15. The position of these reflective surfaces is well defined on a circle concentric to the disk 15. On said circle, the reflective surfaces 13 have angular positions which are perfectly defined with respect to the numbers indicating the thirty-one dates and supported by the upper surface of disk 15. The date disk is in fact a circular ring, the inner edge of which is cogged.

The source 11 and the receiver 14 are disposed so that the beam 12 emitted by the source is reflected into a beam 16 when it falls onto a reflective surface 13, this reflected beam being intercepted by the receiver 14. In practice, the date disk is disposed above the detector and the source.

This receiver provides a signal transmitted to an electronic circuit 17, which, if necessary, controls an electric motor 18 of the stepped type, to drive the date disk 15 via a system of reduction gears 19 and 20. This reducer is designed in such a way that the forward movement of a date corresponds to a whole number of steps, 100 steps of the motor, for example. The motor is designed, for example, so that the rotor has an angular displacement of 180° per step.

The receiver is advantageously formed by a row 21 of photosensitive cells, of which there are four, for example, and respectively bear the references D1, D2, D3 and D4, as shown by FIG. 1B. The photodiodes are advantageously integrated and of the type P+P/N, and developed by a standard procedure as described in the 1987 IEEE Review in the article "Custom Integrated Circuits Conference", Page 712 onwards.

The cells of the receiver 14 and also the emitter or source 11 are both mounted on a support 23 of the electronic circuit 17.

FIG. 1C represents a sectional view along line A—A of FIG. 1B, which clearly illustrates the relative position of the optical device and of the date disk 15.

The photosensitive cells, which are photovoltaic, provide an electric current, the intensity of which is proportional to the intensity of the incident radiation. In the configuration shown by FIG. 2, the row of cells has been subdivided into two groups **21*a* and 21*b* respectively comprising the cells D1 and D2 for the first group and D3 and D4 for the second. The cells of group 21*a* are connected in parallel and provide a current $I_1$ which is the sum of the elementary current intensities provided by the cells of the group. The same applies for the cells in group 21*b*** which provide a current $I_2$.

The electronic circuit is designed in such a way that the grouping of the cells, i.e. the configuration of the two groups **21*a* and 21*b* or the distribution of the cells into these two complementary groups, may be modified according to the function which one desires to perform. The circuit breakers 22*a* and 22*b*** represented in FIG. 2 are electronic. This circuit will be described in more detail further on.

The cells are preferably rectangular in shape and their length is roughly double their width. The illuminated zone or light spot which represents the image of the source in the reflective surface has the shape of a circle $C_1$, which is centred with respect to the cells when the date is centred in the window. One of these functions is precisely the centring of the dates with respect to the window of the watch face. The beam of light emitted by the source is reflected by a reflective surface, inasmuch as such a surface is in an adequate position.

Between two adjacent reflective surfaces 13, the disk is preferably mat and only reflects very little incident light. When the disk is displaced in rotation, and when a reflective surface penetrates the beam 12, the image of the source is displaced on the row of photosensitive cells. The displacement of this image is $1/100^{th}$ of the distance separating two successive dates for one step of the motor, in the case where the distance between two dates corresponds to one hundred steps of the motor. When the arrangement of the cells corresponds to the configuration shown by FIG. 2, the currents $I_1$ and $I_2$ respectively from groups **21*a* and 21*b* correspond to the curves shown by FIG. 3, where the intensities are entered on the y-axis and the angular displacement values of the date disk are entered on the x-axis. The electronic circuit is designed to compare the current $I_1$ with the current $I_2$. At the beginning of the displacement of the disk, i.e. when a reflective surface starts to intercept the beam 12**, the current $I_2$ increases until it reaches a maximum, whereas the current $I_2$ remains roughly constant and weak. If the disk continues to turn, the current $I_1$ decreases and the current $I_2$ increases. Point A corresponds to the ratio $I_1/I_2=1$. The electronic circuit is also designed to detect the moment when the ratio $I_1/I_2$ of the currents exceeds one. This moment corresponds to a position of the disk in which the date is perfectly centred in the window of the face. This ratio is represented graphically by FIG. 4.

Another function of the receiver and the electronic system, which is associated to it, consists in detecting the presence or the absence of a reflective surface when the disk has turned by an angle of 360°/31 dates, i.e. when the motor has received the number of impulses (for example ten steps) necessary for positioning the following date so that it is perfectly centred in the window. This second function can only be performed after the completion of the preceding function, which enabled the detection of the first date to which a reflective surface corresponds and makes it possible to determine whether a reflective surface corresponds or not to the following date. This function is performed by grouping the cells according to a configuration illustrated by FIG. 5. In this configuration, the central cells 21 (D2 and D3) form a first group **21*c* and the lateral cells D1 and D4 constitue a second group 21*d*. Group 21*c* generates a current intensity $I_1$, and group 21*d* generates a current intensity $I_2$. As previously, the circuit breakers 22*c* and 22*d*** are electronic, and their opening and closing operation is controlled by the electronic circuit.

FIG. 6 represents the curves of the current intensities $I_1$ and $I_2$, as a function of the angular position of the date disk.

FIG. 7 represents the ratio of the current intensities $I_1$ and $I_2$ as a function of the angular displacement $\alpha$ of the date disk. The electronic circuit is designed to detect a value $I_1/I_2$ greater than a predetermined threshold k and, as FIG. 8 shows, is designed to supply a binary signal "0" when the ratio $I_1/I_2$ is less than said threshold and a binary signal "1" when the ratio is greater than the threshold. A high ratio, i.e. greater than the threshold k, corresponds to the presence of a reflective surface in the new position of the disk, whereas a ratio of less than k corresponds to the absence of a reflective surface.

It will be noted that each time the device identifies the presence of a mirror, the preceding function may be performed, which enables the correction of lost steps to be automatically performed.

FIG. 8 represents the wiring diagram for the electronic circuit 17, associated to the detector 14. This detector provides signals 30 represented by four arrows corresponding respectively to the four cells of the detector to a unit 31, which comprises the control circuit of the four switches and the switches themselves. It is controlled by a unit 32 which forms the management circuit for the device which is a logical sequential circuit. It transmits signal 33 for controlling the switches to the unit 31.

The unit 31 comprises two outputs which provide two signals 34 and 35, corresponding to the current intensities $I_1$ and $I_2$ respectively, to unit 36. This unit is a circuit for processing the signal which determines the ratio of the intensities $I_1/I_2$ of the currents of the two groups of cells, and detects, in the centring configuration, the passing of this ratio through one. In the other configuration shown, this unit detects the overstepping of the value of the threshold k. It provides a signal 37 which is a logical signal "1" or "0", according to which the presence of a reflective surface is detected or not in the centring configuration and according to which the threshold is exceeded or not, in the detection configuration.

At its input, the unit 32 receives several logical control signals, 38, 39 and 40 respectively. Signal 38, when it assumes the logical level "1", controls the detection of a reflective surface, or the overstepping of the threshold k of the ratio $I_1/I_2$.

Signal 39, when it assumes the logical level "1", controls the centring operation, i.e. the test for the ratio $I_1/I_2$, passing to 1.

Signal 40, when it assumes the logical level "1", controls the test for the ratio $I_1/I_2$ with a threshold k', which is, for example, two times greater than the threshold k. This threshold enables the safety margin of the operation of the detector to be tested, for example during manufacture.

The unit 32 emits an output signal 41, which assumes the logical value "1" when the presence of a reflective surface is detected.

This signal is transmitted to a unit 42 which is an interval register having five binary units of information, and which memorises five presences or absences of reflective surfaces for five consecutive positions of the date disk, which are separated from one another by a value corresponding to five steps of the motor.

This unit provides five logical outputs 43 to a decoder 44 which performs the decoding function of the table shown by FIG. 10.

The five logical outputs 45 of the unit 44 result from the decoding operation performed by this unit and represent the five binary values of the binary code of the states one to thirty-one of the table in FIG. 10 and correspond to the thirty-one dates of the disk.

The operation for detecting the presence or absence of a reflective surface, if it is restarted for the four positions following the detection of a first reflective surface, enables the date displayed, i.e. present in the window, to be identified thanks to a coding principle described below and illustrated by FIGS. 9 and 10.

After having identified the presence of a reflective surface, it is sufficient to move the disk forward by four dates and to read and memorise the presence or the absence of a reflective surface associated with each of them so as to be able to define the date displayed. In fact, if by agreement the binary value "1" is made to correspond to the presence of a reflective surface, and the value "0" is made to correspond to the absence of a reflective surface, it is possible to define a specific sequence of five successive binary numbers corresponding to the code of the position of the date disk for the 31 positions which it comprises.

According to this principle, if a reflective surface as shown by FIG. 9 is associated with the following dates: 1, 2, 3, 4, 5, 8, 9, 11, 14, 19, 21, 23, 24, 25, 27 and 28, the coding of the dates obtained by the application of the principle for attributing the binary code "1" to a date associated with a reflective surface, and the binary code "0" to a date corresponding to the absence of a reflective surface, is the serial code having 31 states shown by FIG. 10.

In practice, the device operates in the following way: When it is switched on, e.g. after a battery change, the electronic circuit controls the advance of the date disk until the detection of a first reflective surface. The first function described ensures centring, i.e. the precise operation of the disk in such a way that a date appears in the exact centre of the window. The electronic circuit then initiates the decoding function by moving the disk forward by four successive dates, by detecting, and then memorising for each of them, the presence or absence of a reflective surface. The code having five binary numbers thus enables it to determine the last date displayed. This operation, called the initialisation operation, is repeated with each battery change. After this phase, the electronic circuit knows the exact position of the date disk. The user may correct the date to make it correspond to the correct date by means such as those described in Swiss patent application no. 04385/87-0. The electronic circuit does not lose the knowledge of the date displayed, as it is this circuit to which a date memory unit, which controls the command for the forward or backward movement of the date disk, is associated.

An identical or simplified procedure may be applied to other displays, particularly the centring of the day reading in the corresponding window.

We claim:

1. A method for the automatic initialisation of at least the date display in a perpetual calendar electronic watch comprising a face fitted with at least one window and at least one date disk driven by an electric motor, which is powered by a battery and controlled by an electronic circuit, this disk being disposed in such a way that the dates appear successively in the window, comprising the steps of:

optically analysing a serial code attributed to the date appearing in the window at the moment the electric circuit is switched on;

automatically identifying the date that appears in the window via the optically analyzed serial code; and memorizing this data.

2. An automatic initialisation device for at least the date display in a perpetual calendar electronic watch, comprising a face fitted with at least one window and at least one date disk driven by an electric motor powered by a battery and controlled by an electronic circuit, this disk being disposed in such a way that the dates appear successively in the window, in which said device is provided with an optical device designed to analyse a serial code attributed to each date appearing in the window, and a memory united to memorise this data, said optical device comprising a fixed source emitting a beam of light, mounted inside the watch beneath the plane of the date disk, a set of reflective surfaces integral with the date disk and disposed on its hidden face through the window, and at least one receiver sensitive to the radiation emitted by the source and disposed inside the watch beneath the plane of the date disk.

3. A device according to claim 2, in which the receiver comprises a series of juxtaposed photosensitive cells, and in that these cells are connected in two groups to the electronic circuit by electronic circuit breakers.

4. A device to claim 3, characterised in that the receiver comprises an even number of photosensitive cells, in that these cells are subdivided into a first group of cells connected in parallel and providing a first current, the intensity of which is proportional to the incident light, and into a second group of cells connected in parallel, the number of which is identical to that of the cells of the first group, and providing a second current, the intensity of which is proportional to the incident light, and in that the electronic circuit comprises means for comparing the values of the intensities of the first and of the second current and for memorising the position of the date disk for which the ratio of these intensities is equal to one.

5. A device according to claim 3, characterised in that the receiver comprises two groups of photosensitive cells, i.e. a group of central cells which are connected in parallel, and a group of lateral cells disposed on both sides of the central cells and which are connected in parallel, and in that the electronic circuit is designed to compare the intensity of the current from the group of central cells and the intensity of the currents from the group of lateral cells, and to memorise the position of the date disk for which the ratio of these two values is greater than a predetermined value.

6. A device according to claim 5, in which the electronic circuit is designed to attribute the binary number (0 or 1) to the dates appearing in the window, for which the ratio of said values is greater than the said predetermined value, and the other binary number (1 or 0) to the dates appearing in the window for which the ratio of said values is less that said predetermined value.

7. A device according to claim 6, in which the electronic circuit comprises a memory unit for memorising the binary number attributed to each date.

8. A device according to claim 7, in which the electronic circuit is designed to identify a date appearing in the window by attributing a code composed of "n" binary numbers corresponding to "n−1" dates adjacent to the date to be identified.

9. A device according to claim 8, in which the code attributed to the dates comprises five binary numbers or binary units of information.

10. A device according to claim 9, in which the code attributed to the dates corresponds to five consecutive states of a serial code having thirty-one states.

* * * * *